United States Patent [19]

Nakajima et al.

[11] Patent Number: 4,894,684

[45] Date of Patent: Jan. 16, 1990

[54] IMAGE FORMING APPARATUS WITH DEVELOPING DEVICE ACCOMMODATING APPARATUS

[75] Inventors: Hisao Nakajima, Kawasaki; Ken Tanabe, Yokohama, both of Japan

[73] Assignee: Canon Kabushiki Kaisha, Tokyo, Japan.

[21] Appl. No.: 166,004

[22] Filed: Mar. 9, 1988

[30] Foreign Application Priority Data

Mar. 10, 1987 [JP] Japan ..... 62-052916
Mar. 10, 1987 [JP] Japan ..... 62-052919

[51] Int. Cl.[4] ..... G03L 15/01

[52] U.S. Cl. ..... 355/207; 355/245; 355/326

[58] Field of Search ..... 355/4, 30 DD, 14 D, 355/3 R, 3 DR, 14 R, 245, 326–328, 207, 208

[56] References Cited

U.S. PATENT DOCUMENTS 4,542,979 9/1985 Percic ..... 355/4
4,615,612 10/1986 Ohno et al. ..... 355/14 D
4,697,915 10/1987 Hayashi et al. ..... 355/4 X

FOREIGN PATENT DOCUMENTS 57-204566 12/1982 Japan ..... 355/327
57-204567 12/1982 Japan ..... 355/245
60-67970 4/1985 Japan .
61-63866 4/1986 Japan .

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

An image forming apparatus includes a main assembly having a developing position, an opening for receiving and delivering developing devices and developing device transportation passage for communicating the developing position and the opening; a developing device accommodating device for accommodating a plurality of the developing devices and for supplying them to the opening; a detecting device for detecting a malfunction of an image forming operation; and a device for transporting the developing device to either the main assembly or the developing device accommodating device in response to detection by the detecting device.

8 Claims, 7 Drawing Sheets

IMAGE FORMING APPARATUS WITH DEVELOPING DEVICE ACCOMMODATING APPARATUS

FIELD OF THE INVENTION AND RELATED ART

The present invention relates to an image forming apparatus such as a copying machine, a recording machine and printer at least optionally equipped with an apparatus for accommodating plural developing devices for an image forming apparatus, more particularly to such apparatuses wherein the developing device is detachably mountable into the image forming apparatus.

Conventionally, a developing apparatus is set in place in an image forming apparatus such as a copying machine by an expert service operator, and thereafter, the user operator does not take the developing device out of the copying machine. Therefore, it has been common that a service man manually inserts the developing device into the assembly to a position, for example, a position where the developing device is near a photosensitive member but is not contacted to the photosensitive member, and then, a manual lever is operated to urge the developing device to the photosensitive drum to correctly position it with respect to the photosensitive member. This type is disclosed in U.S. Pat. Nos. 4,373,468 and 4,583,832, for example.

Recently, however, a new type of image forming apparatus has become widely used wherein the developing device is replaceable with another developing device containing a different color toner such as red and blue in addition to black so as to permit image formation with a different color. With this trend, it is more frequent that the user operator himself mounts the developing device into the apparatus or demount it therefrom. This type is disclosed, for example, in U.S. Pat. Nos. 4,470,689, 4,500,195 and 4,575,221 wherein a process unit containing a photosensitive member and developing means is replaced; and U.S. Ser. No. 802,537 filed on November 27, 1985 and assigned to the assignee of this application, wherein the apparatus contains two developing devices selectively usable, and wherein one of the developing devices is made exchangeable.

There is another proposal, as disclosed U.S. Ser. No. 844,718 filed on March 27, 1986, now U.S. Pat. No. 4,801,966, issued on January 31, 1989, and assigned to the assignee of the present application, wherein two developing devices are made in U.S. Pat. Nos. 4,615,612 and 4,622,916 wherein the apparatus has a turret type developer accommodating means.

However, since all of the above described systems involve manual exchange or replacement of the developing device, it requires cumbersome work and involves the possibility that the developing device will hit the apparatus or the like, thus imparting unnecessary shock or vibration to the developing device.

On the other hand, considering the developing operation, the size of the developer particles is becoming smaller in order to improve the image quality, more particularly the sharpness, with the result that the fluidability of the developer is becoming higher when the developer is mixed with air. Therefore, it is required that the developing device is handled with great care, since otherwise the developer will become distributed in the container non-uniformly, or the developer will be scattered out.

Generally, the non-uniform distribution of the developer in the container is solved by stirring the developer, and in consideration of variations in the manner of handling by different users, the stirring period is made relatively long to cover such wide variations. Therefore, the time required until a first copy is obtained is long after the developing device is exchanged, or after developer is supplied in the type of the device wherein the developing device is demounted from the apparatus for supplying the developer. Where the developing device is limited by a stopper when the developing device is mounted into the apparatus, the degree of resulting non-uniform distribution of the developer and the scattering vary depending on the speed at which the user abuts the developing device to the stopper.

More particularly, in the system wherein the mounting of the developing device is performed by the user, the mounting operation may include closing a drawer by the user, and therefore, the shock imparted to the developing device is different depending on the force applied by the user in mounting it. If strong force, is applied a strong shock is applied in the longitudinal direction of the developing device (in the system wherein the developing device is inserted through a front door of the apparatus in a direction of a generating line of a photosensitive drum contained therein), the developer in the container becomes non-uniformly distributed in the longitudinal direction. And, the developer having been urged to the rear side may blow out through a clearance around a cover of the developing device to scatter out. Particularly, when the developer is replenished, a toner bottle containing a supply of developer to be replenished is shaken so as to increase the fluidability of the developer in order for the developer therein to be completely removed from the developer bottom into the container of the developing device. This makes the developer easy to scatter.

When the developing device is exchanged, the developer contained in the developer container in the developing device usually has been kept stationary for a relatively long period of time, and therefore, the fluidability is not so high. However, if it becomes once non-uniformly distributed, it is required that the developer is positively and relatively strongly stirred by stirring means such as a stirring rod. Therefore, the time period for pre-rotation of the photosensitive member to prepare the apparatus for image forming operation, has to be longer. This also results in a longer time period to the output of the first copy from the start-up of the copying apparatus.

From the users standpoint, various positioning means or other means have to be operated when the developing device is demounted or mounted, and therefore, the mounting or dismounting is cumbersome.

A proposed solution to the above problems is disclosed in U.S. Pat. application Ser. No. 071,316 filed on July 9, 1987 which is assigned to the assignee of the present invention. The proposal contains, as a feature, a passage in the image forming apparatus to allow the developing device to be mounted into or demounted from the apparatus. Further proposals have been made in U.S. patent application Ser. Nos. 111,761 filed October 23, 1987 and 116,657 filed November 5, 1987. Those proposals are a further improvement of this type in that a plurality of developing devices are accommodated and are set in place without requiring cumbersome manipulation by the user.

SUMMARY OF THE INVENTION

Accordingly, it is a principal object of the present invention to provide an image forming apparatus equipped with a developing device accommodating apparatus from which a selected one of the developing devices can be used for image formation, in which an improvement is made in that a recovery operation required at the time when a malfunction such as inadvertent shut down of the power, paper jam, failure of the developing device transportation or other erroneous situation in the image forming operation, can be performed quickly.

It is another object of the present invention to provide an image forming apparatus with a developing device accommodating apparatus wherein sequential operations for the main assembly of the image forming apparatus and the developing device accommodating apparatus are matched in good order.

These and other objects, features and advantages of the present invention will become more apparent upon a consideration of the following description of the preferred embodiments of the present invention taken in conjunction with the accompanying drawings.

According to an embodiment of the present invention, there is provided an image forming apparatus equipped with an external developing device accommodating apparatus for accommodating plural developing devices, wherein the improvement is made for the purpose of quick collection of the developing device possibly halted in a developing device transportation passage, at the time of occurrence of a malfunction. More particularly, developing device detecting means for detecting the presence or absence of the developing device are provided at a developing position in the main assembly of the image forming apparatus, at a developing device delivery portion in the developing device accommodating apparatus and in the developing device transportation passage for connecting the main assembly and the developing device accommodating apparatus, respectively. The presence and absence of the developing device are detected by each of the detecting means, and on the basis of the outcome of the detection, the halted developing device is transported to either of the main assembly and the developing device accommodating apparatus that is closer to the halted developing device.

Another aspect of the present invention is directed to the possibility of the developing device being halted and suspended in the developing device transportation passage upon malfunction occurrences such as inadvertent power shut down and paper jam. If the developing device is stopped bridging between the main assembly and the developing device accommodating apparatus, and if after the malfunction is corrected a developing device which is different from the one selected prior to the malfunction occurrence is selected, the vertical movement of the developing device accommodating apparatus necessary to feed the newly selected developing device into the main assembly may damage the bridging developing device, or the driving mechanism for the vertical movement may be overloaded, with the result that the driving source or the gear in the drive transmission mechanism may be damaged.

Therefore, an image forming apparatus is desired wherein the damage to the developing device is prevented after the cause of the malfunction is removed.

To accomplish this, according to said another aspect, there is provided an image forming apparatus including a developing device accommodating apparatus for accommodating at least two developing devices, transportation means for transporting a selected one of the developing devices in the developing device accommodating apparatus to the main assembly and means for detecting the presence and absence of the developing device, wherein upon recovery from a malfunction, the transportation means is driven for a predetermined period of time while detecting the position of the developing device by the detecting means, so as to drive the developing device in one direction.

Therefore, the developing device halted in the passage by the occurrence of the malfunction is moved to a predetermined position upon the recovery from the malfunction, whereby the possibility of damage to the suspended developing device can be effectively prevented.

DESCRIPTION OF THE PREFERRED EMBODIMENT

Figure 1:
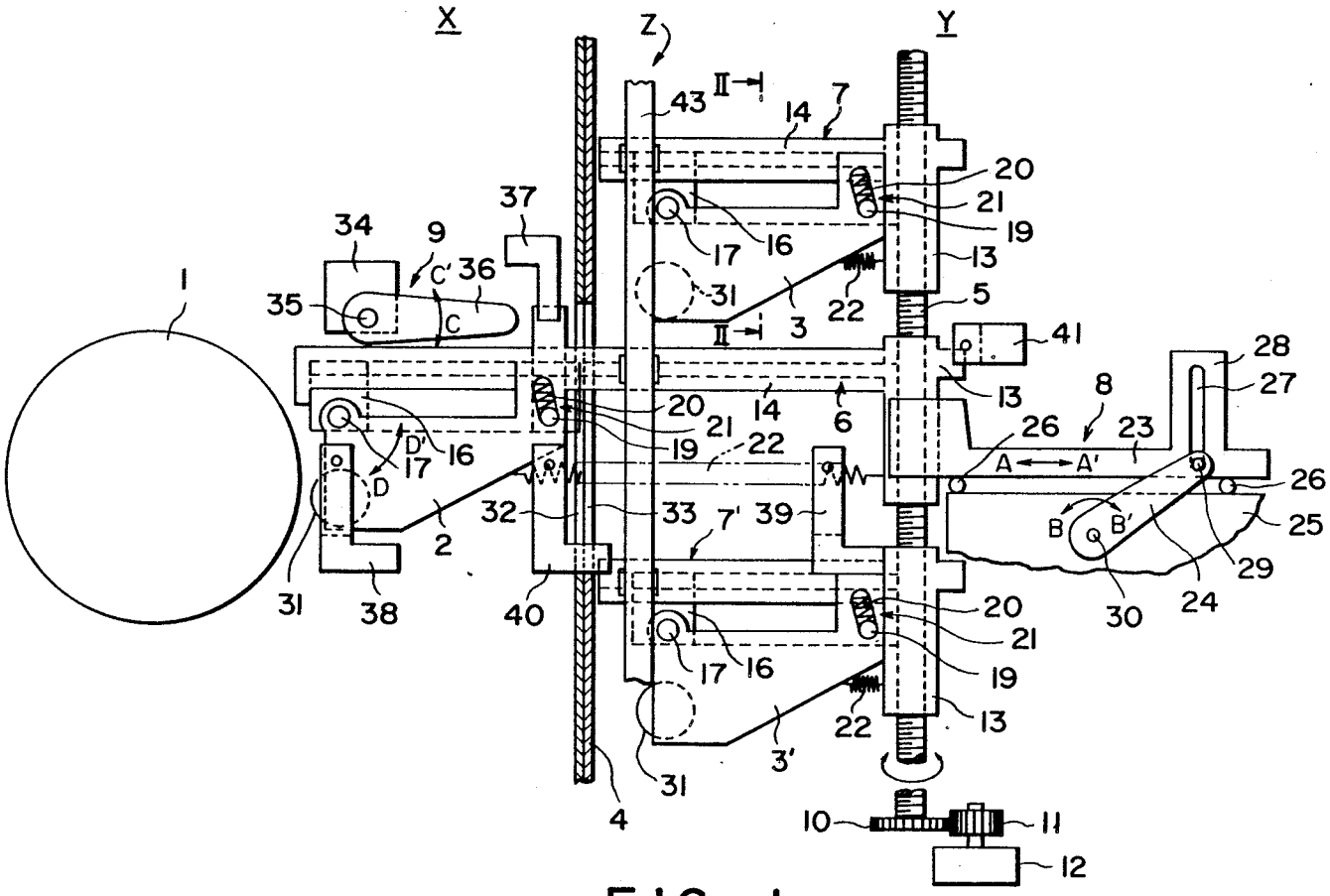
FIG. 1 is a sectional view of a major part of the image forming apparatus according to an embodiment of the present invention.
Figure 3:
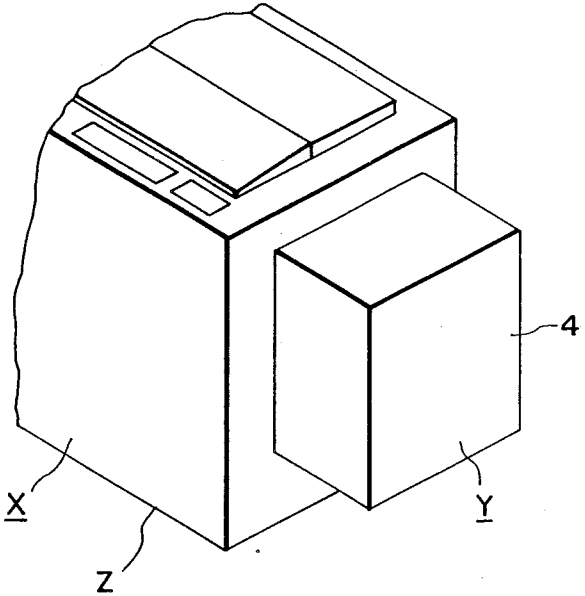
FIG. 3 is a perspective view of the apparatus of FIG. 1.
Figure 2:
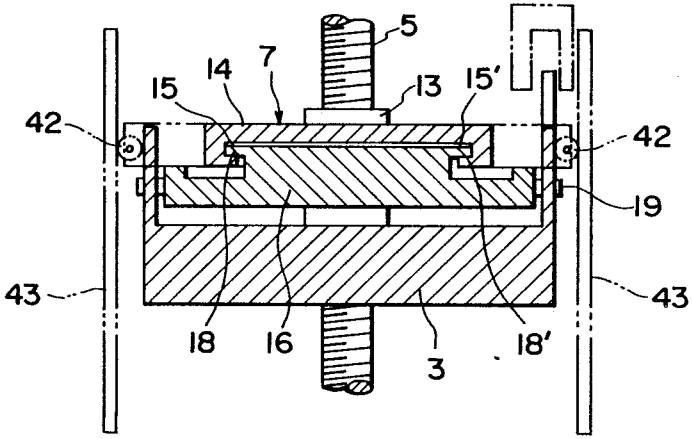
FIG. 2 is a sectional view taken along lines II—II of FIG. 1.

Referring to FIG. 1, there is shown an image forming apparatus according to an embodiment of the present invention. The image forming apparatus is illustrated as being an electrophotographic copying machine, as an example.

Generally, the image forming apparatus Z comprises a main assembly X and a developing device accommodating apparatus Y which is detachably mounted by screws or the like to the main assembly X. The developing device accommodating apparatus Y is capable of accommodating plural developing devices.

The developing device accommodating apparatus Y is disposed ajacent to a photosensitive member or drum 1 in this embodiment in the main assembly X. The developing device accommodating apparatus Y accommodates therein three different color developing devices 2, 3 and 3', which are selectively transportable into the main assembly X upon selection, and maintains the non-selected developing devices in an accommodating case 4 of the developing device accommodating apparatus Y. In the shown example, an intermediate developing device 2 is selected and is placed at a stand-by position adjacent the photosensitive drum 1 in the main assembly X, whereas the upper and lower developing devices 3 and 3' are retained in accommodating case 4.

The developing device accommodating apparatus Y is constituted essentially by accommodating case 4, a lead screw 5 (for vertical movement of accommodating case 4), developing device mounts 6, 7 and 7' mounted to the lead screw 5 with a predetermined distance, a breech 8 for pushing the developing devices 2, 3 and 3' supported on the developing device mounts 6, 7 and 7' toward the photosensitive drum 1 of the main assembly X, a positioning mechanism for positioning the developing devices 2, 3 and 3' with respect to the photosensitive drum 1 after the developing devices 2, 3 and 3' are fed into the main assembly X.

The lead screw 5 is rotationally driven by a reversible motor 12 operatively coupled thereto at a bottom through gears 10 and 11 to shift the developing device mounts 6, 7 and 7' in substantially the vertical direction. The developing device mounts 6, 7 and 7' are moved during the shifting with the space maintained between adjacent ones. The amount of movement is controlled by the rotational amount of the motor.

The developing device mounts 6, 7 and 7' are provided with base portions 13 each having a nut which is in threaded engagement with the lead screw 5. A mount portion 14 is planar, extends horizontally and is provided on the bottom surface with guiding grooves 15 and 15' (rails) which receive sliders of each of the developing devices 2, 3 and 3', which will be described hereinafter.

The developing devices 2, 3 and 3' are each provided on the top surface with a slider 16 rotatably mounted thereto by a pin 17. The slider 16 has engaging walls 18 and 18' at its upper side. The engaging walls are engaged slidably with the guide grooves 15 and 15', by which the developing devices 2, 3 and 3' are mounted to the developing device mounts 6, 7 and 7'. The developing device 2, for example, is connected to the slider 16 at an opposite side from the pin 17 through a reset mechanism 21 including a pin 19 and a coil spring 20.

Additionally, the developing devices 2, 3 and 3' supported on the developing device mounts 6, 7 and 7' are connected to the developing device mounts 6, 7 and 7' by coil springs 22 stretched between the respective developing devices 2, 3 and 3' and the nuts 13.

The breech 8 is disposed at a level for allowing the developing devices 2, 3 and 3' to be positioned to the photosensitive drum 1 (a developing sleeve 31 is pressed toward the photosensitive drum 1 under a predetermined pressure). The breech 8 includes a developing device pressing member 23 and an operation member (a rotatable link 24) for moving the pressing member 23.

The pressing member 23 includes a fork-like plate having fingers between which the nut 13 is interposed and is movable on a frame 25 through rollers 26 provided on the frame 25 toward and away from the developing device mounts 6, 7 and 7' in the direction indicated by an arrows A and A'. A guiding plate 28 integrally extends from the pressing member 23 at a middle portion and is provided with an elongated slot 27 with which a pin 29 at an end of the rotatable link or the operation member 24 is engaged. The rotatable link 24 is provided at a base portion with a shaft engaged with an unshown reversible motor. Upon rotation of the motor, the rotatable link 24 rotates about the shaft 30 in the direction indicated by an arrow B and B', by which the pressing member 23 moves on the frame 25 in the direction A and A', as described hereinbefore to transport the developing devices 2, 3 and 3' toward the photosensitive drum 1. In the state shown in the Figure, the pressing member is urged in the direction A so as to push the developing device 2. By this, the developing device 2 slides on the mount 6 and is transported into the main assembly X to the neighborhood of the photosensitive drum 1 through an opening 33 which is in alignment with a developing device supply opening 32. At this time, the coil spring 22 is stretched to apply force to the developing device 2 in the direction retracting the developing device 2 toward the nut 13. The movement of the pressing member 23 in the directions A and A' is limited by the slot 27 of the guiding plate 28. When the pin 29 of the operation member 24 moves to the bottom of the slots 27, the transportation of the developing device 2 to the development stand-by position is completed. On the other hand, when the pin 29 of the operation member 24 reaches the upper end of the guiding slot 27, the developing device 2 is accommodated in the accommodating case 4.

The positioning mechanism 9 is constituted essentially by a motor 34 and a pressing cam 36 fixedly mounted to a rotational shaft 35 of the motor 34. When the motor 34 is rotated so that the cam 36 takes the vertical position (C), the pressing cam 36 downwardly urges the developing device 2 which has been transported to the neighborhood of the photosensitive drum 1 (the stand-by position for the developing operation). Then, the developing device 2 rotates about the pin 17 in the direction of the arrow and is positioned relative to the photosensitive drum 1, that is, the developing sleeve of the developing device 2 is urged to the photosensitive drum 1 under a predetermined pressure. The coil spring 20 of the reset mechanism 21 applies the force in the direction retracting the developing device 2.

When the pressing cam 36 is rotated in the direction C' so that the cam takes a horizontal position, the reset mechanism 21 rotates the pin 17 in the direction D' to reset the developing device 2 to the original horizontal position. Then, the developing device 2 slides on the mount 6 and is returned into the developing device accommodating apparatus Y by the restoring action of the coil spring 22. The amount of movement (amount of rotation) between the urging state and the releasing state is determined by the amount of the motor 34 rotation.

Reference numerals 37, 38, 39 and 40 designate developing device detecting means provided in the main assembly X, at the developing device delivery position of the developing device accommodating apparatus Y and in the developing device transportation passage between the developing position in the main assembly X and the developing device delivery position. Reference numeral 41 is a developing device mount position detecting means disposed at the developing device delivery position of the developing device accommodating apparatus Y. The detecting means 37 functions to detect the presence and absence of the developing device at the operating position of the developing device. The detecting means 38 functions to detect the presence and absence of the developing device in the main assembly X. The detecting means 39 functions to detect the presence and the absence of the developing device at the developing device delivery position. The detecting means 40 serves to detect the presence and the absence of the developing device in the developing device transportation passage. The position detecting means 41 detects the arrival of the developing device at a predetermined position, in response to which the motor 12 for driving the lead screw is stopped. Those detecting means each include a photosensor in the form of a gate, and produce an output signal when the developing device blocks the light between the legs of the gate, therefore, the output signal represents the presence of the developing device.

The description will be made as to the feeding of the developing device from the developing device accommodating apparatus Y into the main assembly X. In the state shown in the FIG. 1, developing device 2 has been selected and is placed at the stand-by position, that is, it is waiting for being urged. In this state, the detecting means 37 and the detecting means 38 produce output signals. The remaining developing devices, i.e. the developing device 3 and 3' are not selected and are maintained in the developing device accommodating apparatus Y.

In order to position the developing device 2 relative to the photosensitive drum 1 to the operative position, the motor 34 of the driving mechanism 9 is operated to rotate the pressing cam 36 in the direction C, as described hereinbefore. At this time, the detecting means 38 and the detecting means 37 produce their output signals. When the developing device 2 is to be exchanged with another developing device containing the developer having another color, for example the developing device 3, the developing device 2 is first released from the urging force toward the photosensitive drum 1, by operating the motor 34 so as to rotate the cam 36 in the direction C'. Then, the developing device 2 restores the shown position, and simultaneously, is pulled by the coil spring 22 and is slid on the mount 6. At this time, the detecting means 40 and the detecting means 38 or the detecting means 39 produce output signals. The developing device 2 is returned to accommodating case 4. During this, the developing device urging member 23 restores in the direction A'.

Then, the motor 12 is operated to rotate the lead screw 5 to elevate or lower the developing device mounts 7 or 7' and to oppose the developing device 3 or 3' to the developing device urging member 23, at which instance the motor 12 stops in response to the output of the position detecting means 41, and only the detecting means 39 produces the output signal. The developing device 2 is below the opposed position. The developing device mounts 6, 7 and 7' are guided by a guide rail 43 contacted thereto through a roller 42. Thereafter, the developing device urging member 23 of the breech 8 is moved in the direction A by the operation member 24, to feed the newly selected developing device 3 and 3'. Subsequently, the developing device 3 or 3' is urged and positioned relative to the photosensitive drum 1 by the positioning mechanism 9.

It is possible that during the developing device being transported in the manner described above, the developing device is halted halfway of the transportation by a malfunction detected by a malfunction detecting means. The embodiment of the present invention is such that if this occurs, the developing device is moved to whichever of the main assembly X and the developing device accommodating apparatus Y is closer to the developing device. When the developing device is halted during its transportation, the developing device is detected only by the detecting means 40 in one case; it is detected by the detecting means 40 and the detecting means 38 in another case; and it is detected by the detecting means 40 and the detecting means 39 in the other case. A control system controls in response to detection by the malfunction detecting means the developing device driving mechanism to transport the developing device either to the main assembly Xl or to the developing device accommodating apparatus Y, in dependence upon the cases detected by the detecting means. The relation between the direction of movement and the cases of the developing device detection is shown in the following table.

| | outputs of detecting means | | | |
|---|---|---|---|---|
| developing device position | detecting means 38 | detecting means 40 | detecting means 39 | destination of collection |
| delivery position | yes | no | no | no movement |
| passage in X | yes | yes | no | developing position |
| in passage | no | yes | no | delivery position |
| passage in Y | no | yes | yes | delivery position |
| delivery position | no | no | yes | no movement |

With this structure, the developing device can be positioned speedily when the developing device is halted during the transportation between the main assembly and the accommodating apparatus.

As described in the foregoing, according to the embodiment of the present invention, there is provided an image forming apparatus equipped with an external developing device accommodating apparatus for accommodating plural developing devices, wherein the improvement is made for the purpose of quick positioning of the developing device halted in a developing device transportation passage, at the time of occurrence of malfunction. More particularly, developing device detecting means for detecting the presence or absence of the developing device are provided in a developing position in the main assembly of the image forming apparatus, in the developing device delivery portion in the developing device accommodating apparatus, in the developing device transportation passage for connecting the main assembly and the developing device accommodating apparatus, respectively. The presence and absence of the developing device is detected by each of the detecting means, and on the basis of the outcome of the detection, the halted developing device is transported to either of the main assembly and the developing device accommodating apparatus that is closer to the halted developing device. Therefore, the developing device can be quickly moved from the halted position.

The driving means for driving the developing device, the driving means for the vertical movement of the accommodating apparatus, the developing device selecting mechanism or the drive control mechanism may be modified by one skilled in the art as long as the above recovery sequence is satisfied.

This embodiment is particularly effective when the selected developing device prior to the occurrence of the malfunction is no longer selected after the recovery of the malfunction so that the image forming operation after the recovery can be started quickly.

When the developing device is returned to the developing device accommodating apparatus Y, the developing device transportation passage in the main assembly of the image forming apparatus can be serviced without difficulty. Of course, in order for the developing device to be returned to the accommodating apparatus, it is a premise that an empty developing device mount is placed in alignment with the developing device transportation passage of the main assembly.

Figure 4:
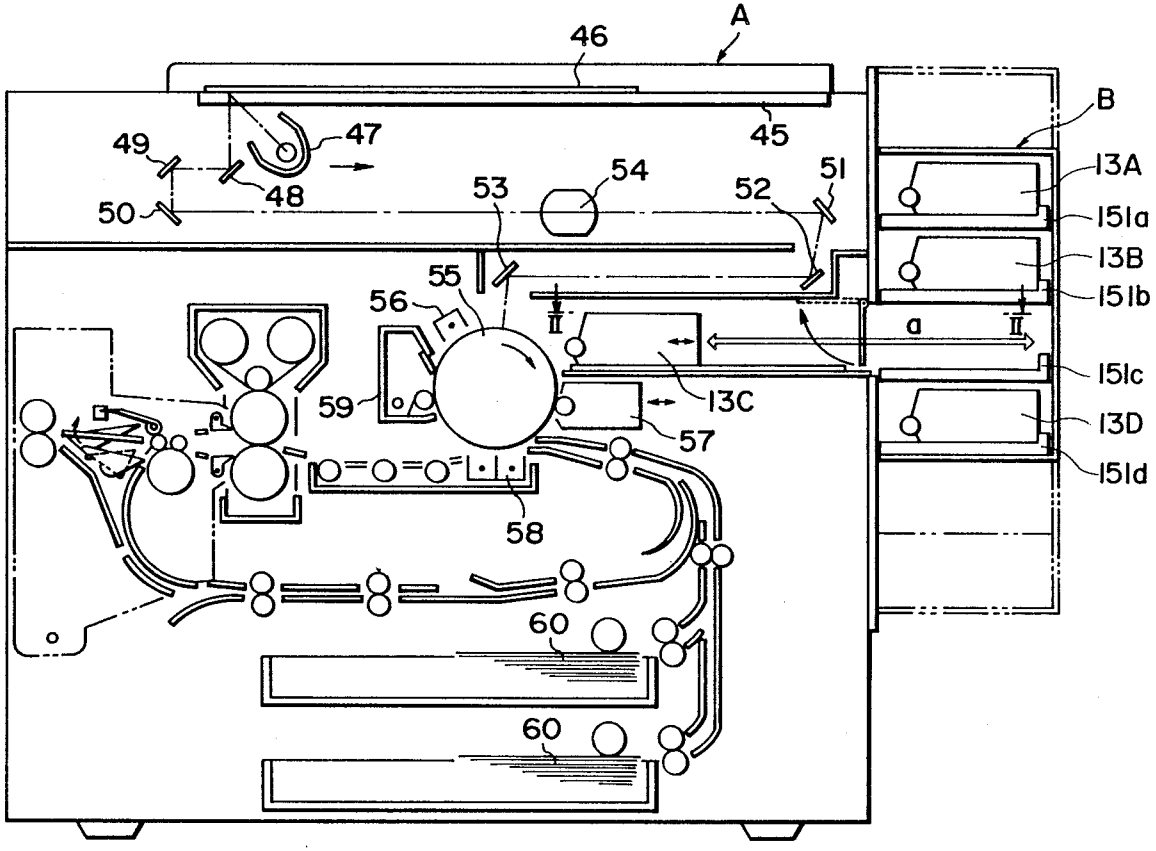
FIG. 4 is a sectional view of a major part of the image forming apparatus according to another embodiment of the present invention.

Referring to FIG. 4, another embodiment of the present invention will be described, wherein a developing device accommodating apparatus B is attached to a main assembly of the image forming apparatus for vertical motion.

First, the description will be made as to the main assembly A. An original 46 to be copied is placed on an original supporting platen glass 45. The original 46 is illuminated by a lamp 3, and a light image formed by the illumination is applied to a photosensitive member or drum 55 (image bearing member) through an optical system constituted by reflecting mirrors 48, 49, 50, 51, 52 and 53 and a zoom lens 54. The lamp 47 and mirrors 47, 48, 49 and 50 travel in a direction indicated by an arrow at predetermined speeds to scan the original 46. On the other hand, the photosensitive drum 55 is uniformly charged by a charger 56 while rotating in a direction indicated by an arrow. Therefore, by the application of the image light to the photosensitive drum 55, an electrostatic latent image is formed on the external surface of the photosensitive drum 55 in accordance with the original image. Around the photosensitive drum 55, there is disposed a green developing device 13C containing a green developer and a black developing device 57 containing a black developer. The green developing device 13C and the black developing device 57 are movable in the direction indicated by arrows. They are movable toward the photosensitive drum 55 when the color thereof is desired to be used to develop the latent image on the photosensitive drum 55. In the state shown in this FIG. 4, the green developing device 13C is away from the photosensitive drum 55 and the red developing device 57 is close to the photosensitive drum 55, so that when the apparatus is operated, a black image is formed.

The toner image formed is transferred onto a transfer material 60 (transfer sheet) by a transfer charger 58. The surface of the photosensitive drum 55 from which the image has been transferred is cleaned by a cleaning device 59 by which the residual developer is removed from the surface, so that the photosensitive drum 55 is prepared for the next image forming operation.

The description will be made with respect to the accommodating apparatus B. It is provided with partition stages 151*a*, 151*b*, 151*c* and 151*d* which are for supporting the red developing device 13A, the blue developing device 13B, the green developing device 13C and the sepia developing device 13D. In the state shown in this Figure, the green developing device 13C is not in the accommodating apparatus B, but is within the main assembly A at a stand-by position adjacent the photosensitive drum 55 where it is waiting for the developing operation instruction. Also, the green developing device 13C can be transported between the developing position shown and the partition 151*c* of the accommodating apparatus B in the direction a by the transportation means shown in FIGS. 5–7.

Figure 5:
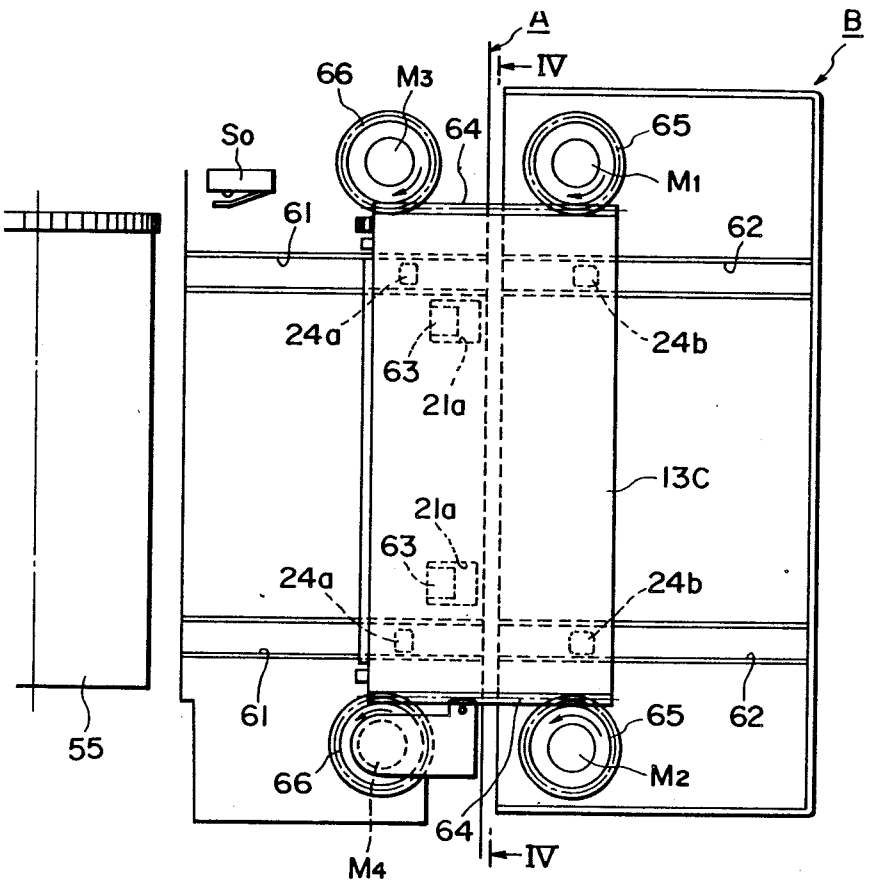
FIG. 5 is a top plan view of a part of the image forming apparatus of FIG. 1 illustrating a driving mechanism for transporting a selected developing device into the main assembly.
Figure 6:
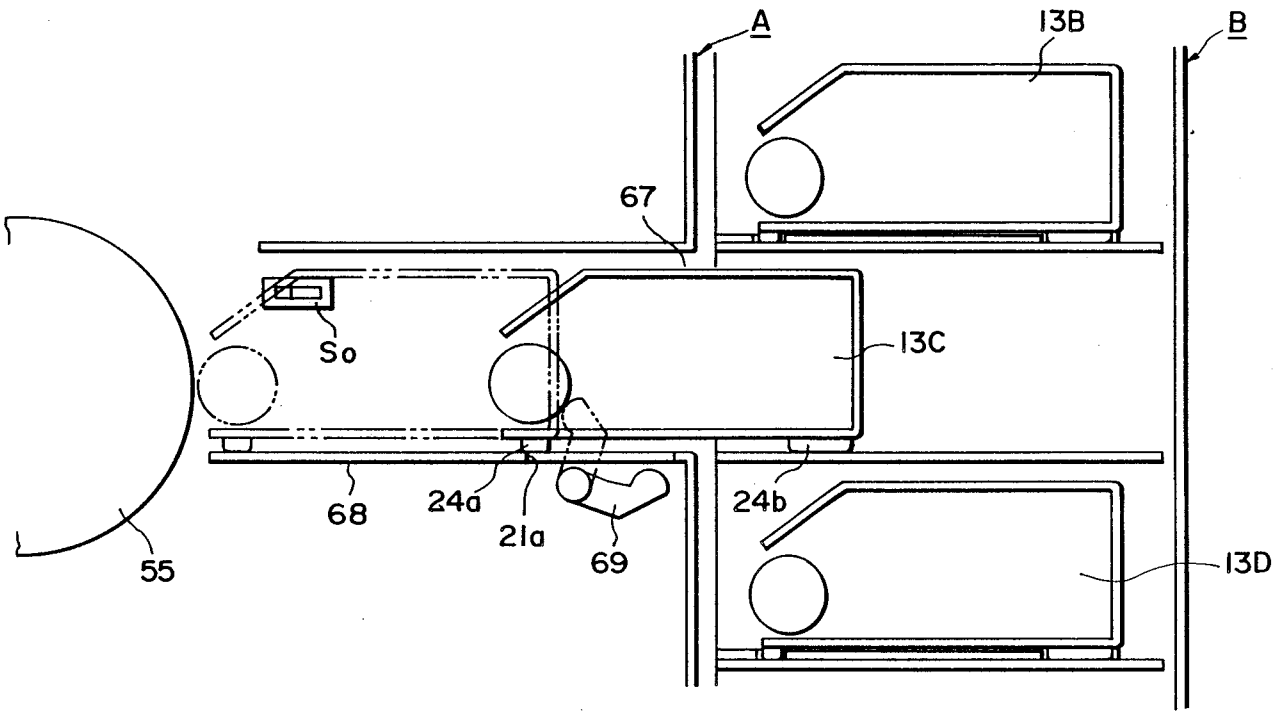
FIG. 6 is a sectional view of a part of the image forming apparatus of FIG. 1 illustrating movement of the selected developing device between the main assembly and the developing device accommodating apparatus.
Figure 7:
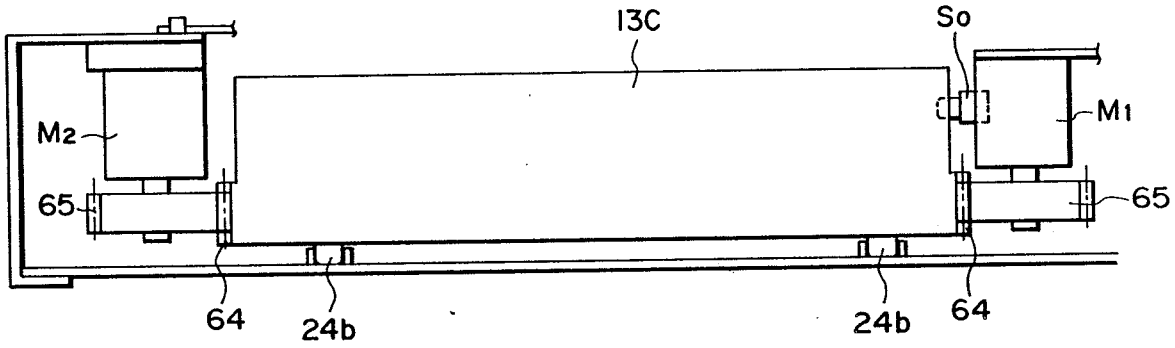
FIG. 7 is a longitudinal section of the image forming apparatus.

Referring to FIGS. 5–7, the description will be made as to the transportation means, wherein FIG. 5 is a sectional view taken along II—II of FIG. 4; FIG. 6 is a partial sectional view illustrating a relation between the photosensitive drum 55 and the accommodating apparatus B; and FIG. 7 is a sectional view taken along lines IV—IV of FIG. 5.

The main assembly A is provided with an opening 67 in the side opposed to the accommodating apparatus B to allow the introduction of the developing device into the main assembly A. Between the opening 67 and the photosensitive drum 55, a transportation passage 68 is formed horizontally within the main assembly A. For the passage 68, two guides 61 and 61 are provided parallel and with a predetermined space as shown in FIG. 5. Correspondingly, each of the partition stages 151*a*, 151*b*, 151*c* and 151*d*, is provided with guides 62 and 62 in the same direction and with the same space.

Each of the developing devices 13A, 13B, 13C and 13D has on its bottom surface guide members 24*a*, 24*a*, 24*b* and 24*b*, which are projected as shown in the Figure.

Rectangular cut-away portions 21*a* and 21*a* are formed at the inside of the guide 61 for the transportation passage 68. The cut-away portions are provided with a pressing cam 69.

Each of the developing devices 13A, 13B, 13C and 13D is provided with racks 64 and 64 on both of the side surfaces. When the developing device 13C is in the accommodating apparatus B, the racks 64 and 64 are in meshing engagement with gears 65 and 65 which are coupled with a reversible DC motors M1 and M2 in the accommodating apparatus B. When the developing device is on the transportation passage 68 in the main assembly A, the racks 64 and 64 are in meshing engagement with gears 66 and 66 which are coupled with DC motors M3 and M4 in the main assembly A.

Adjacent the image forming position of the main assembly A, there is disposed a developing device detecting sensor So for detecting a developing device.

When one of the developing devices 13A, 13B, 13C and 13D, for example, the green developing device 13C is selected and is used for the developing operation, the accommodating apparatus B is driven by an unshown driving means in the vertical direction, and when the 13C comes to the level of the inlet opening 67, the driving means is stopped. Then, the green developing device 13C is aligned with the inlet. The DC motors M1 and M2 are operated to rotate the gears 65 in the direction of arrow shown in FIG. 4, by which the green developing device 13C having the racks 64 and 64 in engagement with the gears 65 and 65 is transported toward the photosensitive drum 55 along the guides 62 and 62. Then, the guide members 24*a*, 24*a*, 24*b* and 24*b* formed on the bottom of the green developing device 13C is brought into engagement with the guides 61 and 61 in the main assembly A, and the racks 64 and 64 are engaged with the gears 66 and 66 of the main assembly A. When the green developing device 13C advances enough for the racks 64 and 64 to be disengaged from the gears 65 and 65, the motors M3 and M4 of the main assembly A are driven so that the gears 66 and 66 is rotated in the direction of arrow. The green developing device 13C is advanced to the neighborhood of the photosensitive drum 55. When this is detected by a sensor So, the DC motor M3 and M4 for driving the gears 66 and 66 are stopped.

Figure 8:
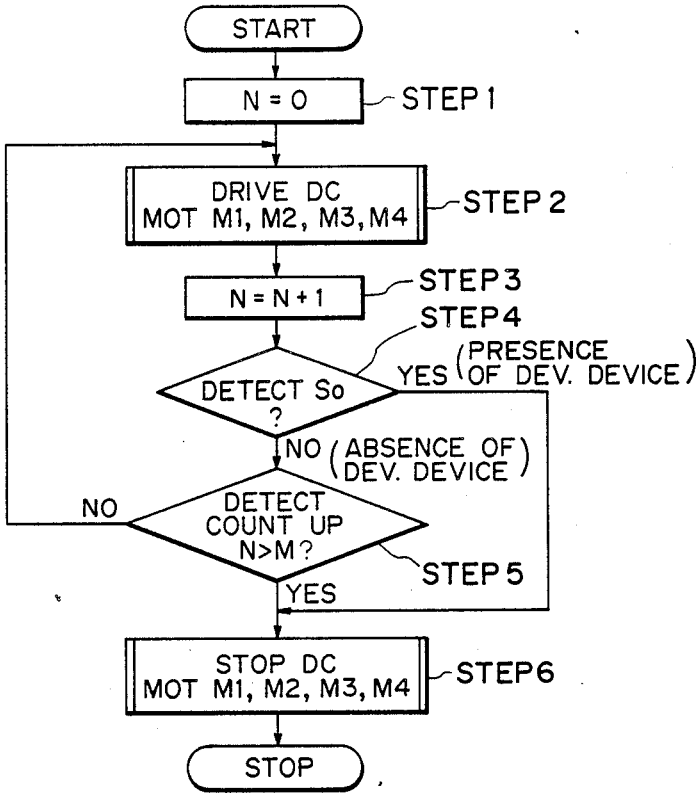
FIG. 8 is a sectional view taken along lines II—II of FIG. 4.

Referring to FIG. 8, the description will be made as to the sequential operation after recovery of a malfunction.

It is possible that the developing device 13C is halted at a position bridging the main assembly A and the developing device accommodating apparatus B during an operation of the main assembly A with another developing device (not shown), due to, for example, inadvertent power shut down, paper jam or the like, as shown in FIG. 6.

In such an occasion, in this embodiment, a timer count is once reset after the power is supplied again or the paper jam is cleared, as shown in the flow chart of FIG. 8 at step 1. Then, DC motors M1, M2, M3 and M4 constituting the transportation means are operated, the developing device 13C is transported from the stop position shown in FIG. 6 by solid lines to the main assembly A, in the leftward direction in this Figure. The rotational directions of the motors M1, M2, M3 and M4 are set to be all for transporting the developing device 13C to the main assembly A.

When the timer counts up at step 3, it is discriminated whether or not the developing device 13C reaches the image forming position indicated by chain lines in FIG. 6 by the sensor So, at step 4. If the sensor So does not detect the developing device 13C, it is discriminated whether or not the timer count reaches a predetermined M at step 5. If not, the sequence goes back to step 2, and the same operation is repeated.

If the sensor So detects the developing device 13C at step 4, the motors M1, M2, M3 and M4 are stopped to stop the transportation of the developing device 13C at step 6. If the developing device 13C is not detected at step 4, and the timer counts up at step 5, it is deemed that the developing device 13C is neither in the main assembly A nor in the developing device accommodating apparatus B, and the motors M1, M2, M3 and M4 are stopped immediately.

After completion of the above described sequence, the above described normal sequence (image forming sequence) is performed.

Figure 9:
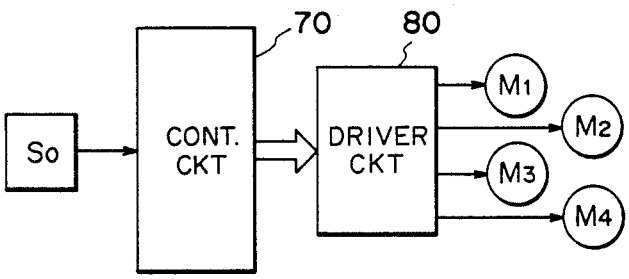
FIG. 9 is a partial sectional view of the image forming apparatus illustrating a relationship between the developing device accommodating apparatus and the photosensitive member.

Referring to FIG. 9, an example of a system for realizing the recovery sequence is described. As shown, the signal from the developing device detecting sensor So is inputted into the control circuit 70. The control circuit 70 receives the signal from the sensor So, and transmits to a driver circuit 80 a control signal determined in accordance with the flow chart of FIG. 8. The driver circuit 80 in turn controls the motors M1, M2, M3 and M4.

As described in the foregoing, even if the developing device 13C is halted at a position shown in FIG. 6 by solid lines due to inadvertent power shut down, paper jam or the like, the motors M1, M2, M3 and M4 are driven for a predetermined period, so that the developing device 13C is shifted to the position indicated by chain lines in FIG. 6 (image forming position). Therefore, the developing device 13C is effectively protected from possible damage due to vertical movement of the developing device accommodating apparatus B or the driving system for the developing device accommodating apparatus B.

In the foregoing description, the developing device 13C only has been explained. However, the operation is the same as this with respect to the other developing devices 13A, 13B and 13D. In the foregoing embodiment, the developing device detecting sensor So is disposed within the main assembly A, but it may be disposed in the developing device accommodating apparatus B, or two such sensors may be provided in both of the main assembly A and the developing device accommodating apparatus B. Where the developing device detecting sensor So is in the developing device accommodating apparatus B, the direction of the developing device transportation in the recovery sequence is for the developing device accommodating apparatus B. Where the sensors are provided in both of the main assembly A and the developing device accommodating apparatus B, the developing device can be detected more quickly, so that the speed of the recovery is increased.

As described, according to this embodiment, there is provided an image forming apparatus including a developing device accommodating apparatus for accommodating at least two developing devices, transportation means for transporting a selected one of the developing devices in the developing device accommodating apparatus to the main assembly and means for detecting presence and absence of the developing device, wherein upon recovery from the malfunction, the transportation means is driven for a predetermined period of time while detecting the position of the developing device by the detecting means, so as to drive the developing device in one direction.

Therefore, the developing device halted in the passage by the occurrence of a malfunction is moved to a predetermined position upon the recovery from the malfunction, whereby the possibility of damage to the suspended developing device can be effectively prevented.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a main assembly having a developing position, an opening for receiving and delivering a developing device and a developing device transportation passage extending between the developing position and the opening;

developing device accommodating means for accommodating a plurality of developing devices and for supplying them to the opening;

detecting means for detecting a malfunction of an image forming operation; and means for transporting a selected one of said developing devices to said developing device accommodating means in response to detection by said detecting means.

2. An apparatus, according to claim 1, wherein said detecting means includes means for detecting a position of the developing device in the transportation passage.

3. An apparatus, according to claim 2, wherein said developing device position detecting means is effective to detect the developing device adjacent the opening, and the malfunction is detected by detecting the developing device halted there.

4. In image forming apparatus, comprising:

a main assembly having a developing position, a transportation passage for transporting a developing device and means for moving the developing device toward and away from the developing position;

developing device accommodating means for accommodating a plurality of the developing devices, having means for supplying a selected one of said developing devices to said passage and for receiving said one developing device from the passage;

monitoring means for monitoring movement of said one developing device in said main assembly and in said developing device accommodating means;

detecting means for detecting a malfunction of an image forming operation; and control means responsive to said monitoring means to perform an operation in which when said monitoring means detects the presence of said one developing device in a boundary between the transportation passage and said developing device accommodating means upon detection of the malfunction by said detecting means, said one developing device is transported either into said main assembly or into said developing device accommodating means, whereas when said monitoring means detects the presence of said one developing device in said main assembly or in said developing device accommodating means, said one developing device is not moved.

5. An image forming apparatus, comprising:

a main assembly;

developing device accommodating means for accommodating a plurality of developing devices, from which a selected one of the developing devices is capable of being supplied to a developing position in said main assembly; and developing-device detecting means disposed at the developing position in said main assembly, at a developing device delivery position of said developing device accommodating means for delivery of the developing devices to said main assembly and in a developing device transportation passage between the developing position and the developing device delivery position, respectively;

wherein when an image forming operation of said image forming apparatus stops, said one developing device which is halted in said transportation passage is detected by said developing device detecting means, and on the basis of an outcome of the detection, said halt developing device is moved back into the one of said main assembly and said developing device accommodating means which is nearer to said halted developing device.

6. An image forming apparatus, comprising:

a main assembly having a developing position, a transportation passage for transporting a developing device and means for moving the developing device toward and away from the developing position;

developing device accommodating means for accommodating a plurality of developing devices, including means for supplying a selected one of said developing devices to said passage and for receiving said developing device from the passage;

detecting means for detecting a malfunction of said image forming apparatus; and control means responsive to said detecting means to forcibly transport to said main assembly the developing device engaged with one or both of said moving means and said supplying means.

7. An image forming apparatus, comprising:

a main assembly;

developing device accommodating means for accommodating at least two developing devices;

transportation means for transporting a selected one of said developing devices from said developing device accommodating means;

detecting means for detecting the presence and absence of the developing device; and control means, operative upon a recovery operation from a malfunction of said image forming apparatus, to drive said transportation means for a predetermined period, while said detecting means is detecting a position of the developing device, to move the developing device in a predetermined fixed direction.

8. An image forming apparatus, comprising:

a main assembly having a developing position, a transportation passage for transporting a developing device and means for moving the developing device toward and away from the developing position;

developing device accommodating means for accommodating a plurality of developing devices, including means for supplying a selected one of said developing devices to said passage and for receiving the said one developing device from the passage; and control means for forcibly transporting the developing device, which has been stopped due to a malfunction of said image forming apparatus during its transportation, to a predetermined position in said main assembly or said accommodating device, after the malfunction is cleared.

* * * * *

UNITED STATES PATENT AND TRADEMARK OFFICE

CERTIFICATE OF CORRECTION

PATENT NO. : 4,894,684

DATED : January 16, 1990

INVENTOR(S) : HISAO NAKAJIMA, ET AL.

It is certified that error appears in the above-identified patent and that said Letters Patent is hereby corrected as shown below:

IN [57] ABSTRACT

Line 3, "developing" (second occurrence) should read --a developing--.

COLUMN 1

Line 38, "demount" should read --demounts--.
Line 51, "made in" should read --made selectively operable. Yet another proposal has been made in--.

COLUMN 2

Line 23, "force," should read --force--.

COLUMN 4

Line 66, "ajacent" should read --adjacent--.

COLUMN 5

Line 67, "an" should be deleted.

COLUMN 6

Line 24, "slots" should read --slot--.

COLUMN 7

Line 20, "the FIG. 1," should read --FIG. 1, the--.
Line 60, "and" should read --or--.

UNITED STATES PATENT AND TRADEMARK OFFICE

CERTIFICATE OF CORRECTION

PATENT NO. : 4,894,684

DATED : January 16, 1990

INVENTOR(S) : HISAO NAKAJIMA, ET AL.

It is certified that error appears in the above-identified patent and that said Letters Patent is hereby corrected as shown below:

COLUMN 8

Line 10, "controls" should read --controls,--.
Line 11, "means" should read --means,--.

Lines 22-24, "destination of collection" should read --destination of movement--.

COLUMN 10

Line 65, "is" should read --are--.

COLUMN 12

Line 65, "In" should read --An--.

COLUMN 13

Line 47, "halt" should read --halted--.

Signed and Sealed this

Twenty-third Day of June, 1992

*Attest:*

*Attesting Officer*

DOUGLAS B. COMER

*Acting Commissioner of Patents and Trademarks*